US008955560B2

(12) United States Patent
Clüsserath

(10) Patent No.: US 8,955,560 B2
(45) Date of Patent: Feb. 17, 2015

(54) METHOD FOR THE PRESSURSED FILLING OF BOTTLES OR LIKE CONTAINERS, AND FILLING SYSTEM AND FILLING MACHINE FOR CARRYING OUT SAID METHOD

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 789 days.

(21) Appl. No.: 13/145,821

(22) PCT Filed: Feb. 6, 2010

(86) PCT No.: PCT/EP2010/000753

§ 371 (c)(1),
(2), (4) Date: Jul. 22, 2011

(87) PCT Pub. No.: WO2010/094409

PCT Pub. Date: Aug. 26, 2010

(65) Prior Publication Data

US 2011/0272057 A1 Nov. 10, 2011

(30) Foreign Application Priority Data

Feb. 17, 2009 (DE) ..... 10 2009 009 340

(51) Int. Cl.

| | |
|---|---|
| ***B65B 31/00*** | (2006.01) |
| ***B67C 3/06*** | (2006.01) |
| ***B67C 3/26*** | (2006.01) |
| *B67C 3/08* | (2006.01) |

(52) U.S. Cl.
CPC ... *B67C 3/06* (2013.01); *B67C 3/08* (2013.01); *B67C 3/262* (2013.01)
USPC ..... 141/59; 141/6; 141/145; 141/284; 141/290; 141/302

(58) Field of Classification Search
CPC ..... B67C 3/06; B67C 3/08; B67C 2003/2671
USPC ..... 141/6, 39, 40, 47, 48, 59, 144–147, 141/284, 290, 301, 302
See application file for complete search history.

(56) References Cited

U.S. PATENT DOCUMENTS

| | | | | |
|---|---|---|---|---|
| 5,119,853 | A | 6/1992 | Petri et al. | |
| 8,434,529 | B2 * | 5/2013 | Goldbrunner | 141/59 |
| 2010/0307639 | A1 | 12/2010 | Goldbrunner | |

FOREIGN PATENT DOCUMENTS

| | | |
|---|---|---|
| DE | 2856944 | 4/1980 |
| DE | 3040880 | 5/1982 |
| DE | 3725609 | 2/1989 |
| DE | 102005003222 | 7/2006 |
| DE | 102007035872 | 2/2009 |
| EP | 1544157 | 6/2005 |
| FR | 2675793 | 10/1992 |

* cited by examiner

*Primary Examiner* — Jason K Niesz
(74) *Attorney, Agent, or Firm* — Occhiuti & Rohlicek LLP

(57) ABSTRACT

The invention relates to a method for the pressurized filling of bottles or like containers with a liquid filling material, using a return gas tube protruding into the respective container during a filling phase in order to control the filling level.

10 Claims, 2 Drawing Sheets

Figure 1:
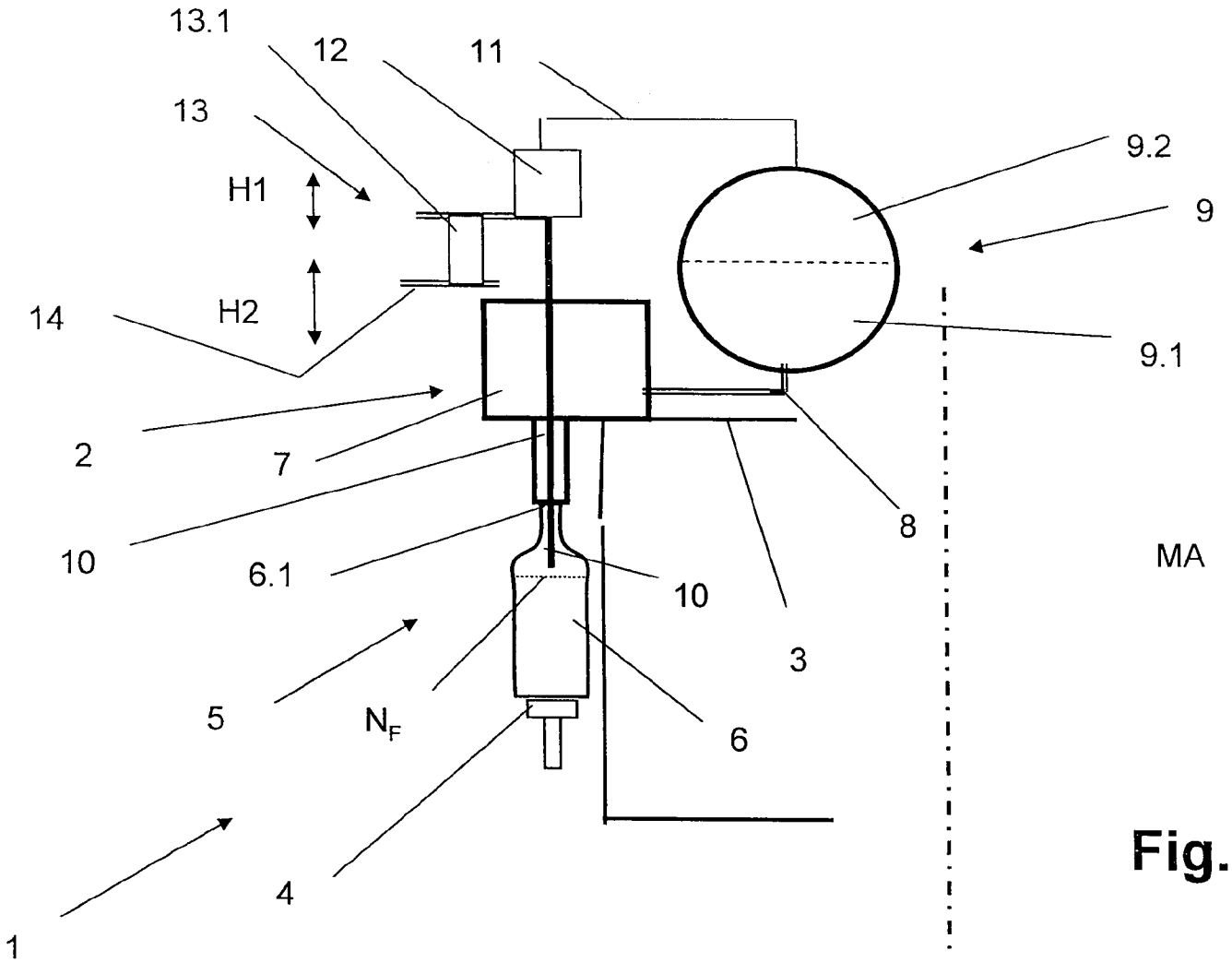

METHOD FOR THE PRESSURSED FILLING OF BOTTLES OR LIKE CONTAINERS, AND FILLING SYSTEM AND FILLING MACHINE FOR CARRYING OUT SAID METHOD

CROSS-REFERENCE TO RELATED APPLICATIONS

This application is the national stage entry, under 35 USC 371, of International Application No. PCT/EP2010/000753, filed on Feb. 6, 2010, which claims the benefit of the priority date of German Patent Application No. 10 2009 009 340.0, filed on Feb. 17, 2009. The contents of both applications are hereby incorporated by reference in their entirety.

The invention relates to a method according to the preamble of patent claim 1, to a filling system according to patent claim 4 and to a filling machine according to the preamble of patent claim 8.

The filling of bottles or other containers under pressure (pressurised filling) with a liquid filling material, in particular with a $CO_2$-bearing filling material, and filling systems or filling machines suitable for this, are known in different embodiments. With such filling systems or filling machines it is also known in particular that in order to control the fill height, i.e. for fill-height-controlled filling, return gas tubes are provided which protrude into the interior of the container that is to be filled and through which the pressurised gas displaced by the filling material escapes, at least at the end of the particular filling phase, so that after the return gas tube is immersed into the surface of the filling material rising in the container concerned, the inflow of filling material in the container is ended and then a depressurising of the filled container can be initiated after the closing of the liquid valve provided in the filling element and after the closing of the return gas channel. Such filling systems have comprehensively proven to be of value in practice and are used in particular in methods and filling systems for filling containers under pressure (pressurised filling). A disadvantage with this however is that with known filling systems, at the moment of depressurisation the particular return gas tube is located immediately above the filling material surface in the container concerned, i.e. at a distance of only about 1.5 to 3 mm above this filling material surface, and that after the end of the filling phase and before depressurisation is initiated, a gas volume at high pressure, for example at a pressure between 4 and 5 bar, is present not only in the head space of the container above the filling material surface but also in the gas tube where it exists as a thin column of gas. At the moment of depressurisation of the container interior, the column of gas present in the return gas tube expands, generating a violent gas surge or pressure pulse escaping at the opening of the return gas tube and which is directed right at the filling material surface in the container and in particular which causes an undesirable violent frothing of the filling material if the filling material is prone to frothing, for example if the filling material has a high $CO_2$ content.

The object of the invention is to provide a method which avoids the afore-mentioned disadvantages of pressurised filling with a return gas tube which controls the filling height. A method according to patent claim 1 is configured to resolve this object. A filling system and a filling machine for carrying out the method are the subject-matter of patent claims 4 and 8 respectively.

In the invention, when pressurised filling with the return gas tube controlling the filling height, before depressurisation is initiated the particular return gas tube is raised so that it is disposed with its return gas opening at a sufficient distance above the level of the surface of the filling material in the container, i.e. at a distance of considerably more than 3 mm, and so that the gas surge or pressure pulse released from the return gas opening upon depressurisation loses most of its energy in the space above the filling material surface and does not result in an undesirable frothing of the filling material.

Embodiments of the invention are the subject-matter of the dependent claims.

The invention is explained in more detail below by reference to FIGS. 1 and 2 each of which shows a simplified representation of a filling element of a filling system of a rotary-type filling machine.

The filling system generally indicated by 1 in FIG. 1 is part of a rotary filling machine and consists in essence of a plurality of filling elements 2 which are provided distributed about the circumference of a rotor 3 that can be driven to rotate about a vertical machine axis MA, said filling elements 2 being at equal angular distances about the machine axis. Together with their container supports 4, filling elements 2 form filling positions 5 to which containers or bottles 6 that are to be filled are transferred in the manner known to a person skilled in the art to a container inlet of the filling machine and from which filled bottles 6 are removed at a container outlet of the filling machine. The filling of containers 6 is effected on the angular range of the rotary trajectory of rotor 3 between the container inlet and the container outlet. Filling system 1 is configured for a filling-height-controlled pressurised filling of containers 6, in which (pressurised filling) containers 6 are disposed with their container mouth region 6.1 in a sealed position against the filling element 2 concerned, at least during a preload phase in which containers 6 are subjected to the pressure of an inert gas, in a subsequent filling phase in which the filling-height-controlled introduction of the liquid filling material into containers 6 is effected, and in a subsequent depressurisation phase.

Each filling element 2 comprises in detail a housing 7 in which is configured, in the manner known to a person skilled in the art, a liquid channel which at one end is connected by a line 8 to a liquid material space or filling material space 9.1 of a boiler 9 and which at the other end forms—on the underside of the filling element 2 concerned—a delivery opening through which the liquid filling material flows to container 6 disposed in a sealed position against filling element 2 during filling. Annular boiler 9 is provided for all filling elements 2 of the filling machine on rotor 3 in common. In the interior of the only part-filled annular boiler 9, a gas space 9.2 is formed above the liquid space 9.1 present therein and/or above the filling material surface, said gas space 9.2 being filled in a pressure-controlled manner with the pressurised inert gas, for example $CO_2$ gas.

The controlled delivery of the filling material in the particular container 6 is effected by opening and closing a liquid valve that is disposed in the liquid channel and which at the start of the particular filling process is opened and then closed when the surface of the liquid filling material in the particular container 6 has reached a given filling height. In housing 7 of filling element 2 there are further provided different gas channels which are controlled by control valves 10 and through which for example at least the preloading of the particular container 6 with the pressurised inert gas, for example with $CO_2$ gas, from gas space 9.2 of annular boilers 9 is effected before the actual filling phase, and through which container 6 is depressurised to ambient pressure, for example is multiple stages, after the end of the filling phase and after the closing of the liquid valve of particular filling element 2.

To control the filling height, every filling element 2 has a return gas tube 10 which is disposed on the same axis as filling element axis FA, is open at both ends and during filling extends with its lower length through container mouth 6 into the interior of container 6 present at filling position 5 and with its upper end is connected by a line 11 with a return gas valve to gas space 9.2 of annular boiler 9, such that during the filling phase the inert gas displaced by the liquid filling material from preloaded container 6 can flow through return gas tube 10 and line 11 into gas space 9.2 of the annular boiler with return gas valve 12 open. The flowing of the filling material in the particular container 6 ends automatically as soon as the surface of the liquid filling material in container 6 has reached the lower open end of gas tube 10 or this lower end is immersed into the filling material surface.

After the subsequent closing of the liquid valve of filling element 2 and after the closing of return gas valve 12, container 6 is depressurised, with a depressurisation of gas tube 10 associated with a, for example, pulse-like exit of inert gas at the lower end of gas tube 10 also taking place at the same time. To prevent the inert gas that exits gas tube 10 during depressurisation, or the attendant inert gas pulse, from causing the frothing of the filling material, for example of a filling material prone to frothing, e.g. one with a high $CO_2$ content (e.g. beer), an actuator or operating element 13.1 is provided which is part of an operating device 13 and with which the axially, i.e. in the direction of filling element axis FA, displaceable return gas tube 10 is raised after the liquid valve of filling element 2 closes and before depressurising, so that the lower end of gas tube 10 is then significantly above the level $N_F$ of the filling material surface inside the particular container 6 and so that the insert gas pulse which exits return gas tube 10 during depressurising cannot lead to an undesirable frothing of the filling material. This depressurising stroke generated by operating element 13.1 is indicated by H1 in FIG. 1.

Operating element 13.1 is for example a pneumatically controllable operating element, e.g. a pneumatically controllable lifting cylinder, with which the raising and/or axial displacing of gas tube 10 by depressurising stroke H1 is possible.

To allow the filling height to be set for all filling positions 5, filling system 1 is provided with a central filling height setting element 14 for all filling elements 2 in common and which is also part of operating device 13 and with which the axially displaceable return gas tubes 10 of all filling elements can be axially raised and lowered centrally and together, as indicated in FIG. 1 by the double-ended arrow H2 (filling height setting stroke). Operating elements 13.1 separately provided for each filling position 5 and individually controllable are disposed on filling height setting element 14 such that depressurising stroke H1 is superimposed on setting stroke H2. The setting of the filling height according to filling height setting stroke H2 is effected, if necessary, essentially once at the beginning or before the commencement of the filling operation.

Figure 2:
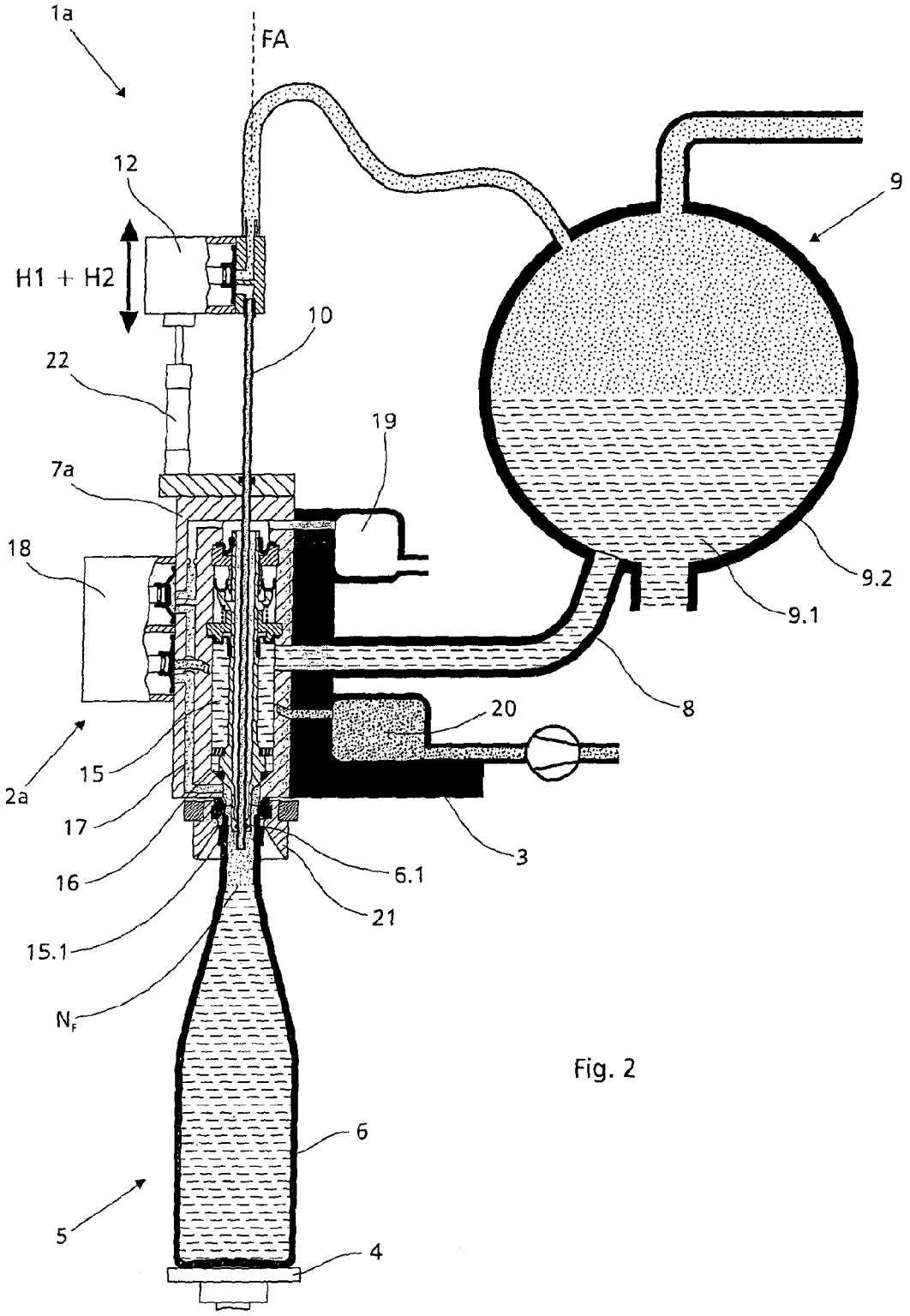

In a representation similar to that of FIG. 1, FIG. 2 shows a filling position 5 of a filling system 1*a* of a rotary filling machine, wherein filling position 5 again consists in essence of filling element 2 provided on rotor 3 and associated container support 4. FIG. 2 shows the previously mentioned liquid channel 15 configured in housing 7 of filling element 2*a*, a valve body 16 disposed in this liquid channel and forming the liquid valve, and various gas channels or gas paths 17 configured in filling element housing 7 and which can be connected in a controlled manner by control valves 18 inter alia to ring channels 19 and 20 provided on the rotor for all filling elements 2*a* in common. FIG. 2 further shows return gas tube 10 that is disposed on the same axis as filling element axis FA and open at both ends, and which during the filling phase extends through the delivery opening 15.1 formed by liquid channel 15 into container 6, passing through container mouth 6.1 with which container 6 lies in sealed contact against filling element 2*a* by way of a seal on a centering tulip 21.

The upper end of return gas tube 10 is in turn connected by return gas valve 12 and line 11 to pressurised gas space 9.2 of annular boiler 9. An operating device 22 having actuators can axially displace return gas tube 10 by the travel of a depressurising stroke H1 from a lower start position during the filling-height-controlled filling and an upper depressurising position during the depressurising of filled container 6 after the closing of liquid valve 16 and return gas valve 12. Raising return gas tube 10 into the depressurising position after the end of the actual filling phase and before depressurising again ensures that an inert gas stream or inert gas pulse exiting the lower end of gas tube 10 does not cause a frothing of the liquid filling material in filled container 6. At the same time operating device 22 allows a setting of the filling height, i.e. an adjustment of at least the start position of return gas tube 10. Operating device 22 is provided separately for each filling element 2*a* and is again a pneumatic operating device for example. Each operating device 22 possesses at least one operating or lifting element, but preferentially two operating and lifting elements, of which one operating or lifting element effects depressurising stroke H1 and can be individually controlled at each filling element 2*a*, while for setting the filling height the other operating element effects the adjustment of at least the start position of depressurising stroke H1 and can be controlled in common together with the corresponding operating elements of the other filling elements 2*a*.

The invention has been described hereinbefore by reference to embodiments. It goes without saying that numerous variations as well as modifications are possible without departing from the inventive concept underlying the invention.

REFERENCE LIST

1, 1*a* Filling system
2, 2*a* Filling element
3 Rotor
4 Container support
5 Filling position
6 Container
6.1 Container mouth
7,7*a* Filling element housing
8 Line
9 Annular boiler
9.1 Liquid space in the annular boiler 9
9.2 Gas space in the annular boiler 9
10 Return gas tube
11 Line
12 Return gas valve
13 Operating device
13.1 Operating element
14 Central filling height adjustment
15 Liquid channel in the filling element housing 7*a*
15.1 Delivery opening
16 Liquid valve
17 Gas channel or gas path
18 Control valve
19,20 Ring channel
21 Centering tulip
22 Operating device
H1 Axial depressurising stroke of return gas tube 10

H2 Axial filling height setting stroke of return gas tube 10
MA Machine axis
FA Filling element axis
$N_F$ Level of the filling material surface

The invention claimed is:

1. An apparatus for depressurized filling of a container with a liquid filling material, said apparatus comprising filling elements, and an operating device, wherein said operating device comprises a central filling level adjusting element common to all of said filling elements, and individually triggerable operating elements, each of which corresponds to a filling element, wherein said operating elements are provided on said central filling level adjusting element, wherein each of said filling elements comprises a return gas tube having an opening at an end thereof, said end of said return gas tube protruding, during operation, into an interior of a container to be filled with said liquid filling material that is disposed in a sealed position against said filling element, wherein said return gas tube is axially movable relative to said filling element in order to control a filling level of said liquid filling material in said container, wherein said central filling level adjusting element is configured to axially move all of said return gas tubes relative to their corresponding filling elements during a setting stroke, wherein said operating element is configured to execute a preset depressurizing stroke that axially moves said end of said return gas tube relative to said filling element from a lower initial position, which determines said filling level, to a raised depressurizing position, wherein said operating element is configured to cause axial movement to occur after closing of a liquid valve associated with said filling element and before said container is depressurized, and wherein said operating element is further configured to superimpose said preset depressurizing stroke on said setting stroke.

2. The apparatus of claim 1, wherein said operating device is configured for common height adjustment of at least a group of said return gas tubes for setting said filling height.

3. The apparatus of claim 2, wherein said at least a group of said return gas tubes comprises all of said return gas tubes.

4. The apparatus of claim 1, wherein said operating device comprises separate operating elements, each of which corresponds to a corresponding filling element.

5. The apparatus of claim 4, wherein said operating element comprises an actuator.

6. The apparatus of claim 1, wherein said operating elements are provided at said central filling level adjusting element.

7. The apparatus of claim 1, further comprising a rotary filling machine comprising a rotor that can be driven about a vertical machine axis thereof, wherein said filling elements are disposed around a circumference of said rotor.

8. A method for depressurized filling of a container with a liquid filling material using an apparatus comprising filling elements, and an operating device, wherein said operating device comprises a central filling level adjusting element that is common to all of said filling elements, and individually triggerable operating elements, each of which corresponds to a filling element, wherein said operating elements are provided on said central filling level adjusting element, wherein each of said filling elements comprises a return gas tube that has an opening at an end thereof, said end of said return gas tube protruding, during operation, into an interior of a container that is disposed in a sealed position against said filling element, wherein said return gas tube is axially movable relative to said filling element in order to control a filling level in said container, said method comprising, during a setting stroke, causing said central filling level adjusting element to axially move all of said return gas tubes relative to their corresponding filling elements, introducing liquid filling material into said containers, closing valves that allow introduction of said liquid filling material into said container, and before depressurizing said containers, causing each of said operating elements to superimpose a preset depressurizing stroke on said setting stroke, wherein superimposing said preset depressurizing stroke on said setting strike comprises causing execution of a preset depressurizing stroke that axially moves said end of said return gas tube relative to said filling element from a lower initial position, which determines said filling level, to a raised depressurizing position.

9. The method of claim 8, further comprising, prior to depressurization, setting said filling height by axially displacing a starting position of said return gas tube.

10. The method of claim 8, further comprising, after superimposing said depressurizing stroke on said setting stroke, depressurizing said container.

* * * * *